United States Patent [19]

Nagasawa et al.

[11] 4,016,236

[45] Apr. 5, 1977

[54] PROCESS FOR MANUFACTURING AROMATIC POLYMER FIBERS

[75] Inventors: Keisaku Nagasawa; Masashi Mitsuishi; Hiroshi Suzuki; Tetsuo Matsushita, all of Nobeoka, Japan

[73] Assignee: Asahi Kasei Kogyo Kabushiki Kaisha, Osaka, Japan

[22] Filed: May 12, 1975

[21] Appl. No.: 576,745

[30] Foreign Application Priority Data

May 15, 1974 Japan ..... 49-53392
July 5, 1974 Japan ..... 49-62794

[52] U.S. Cl. ..... 264/184; 264/168; 264/210 F

[51] Int. Cl.[2] ..... D01D 5/06

[58] Field of Search ..... 264/184, 168, 210 F

[56] References Cited

UNITED STATES PATENTS 3,154,609 10/1964 Cipriani ..... 264/184

3,767,756 10/1973 Blades ..... 264/184

*Primary Examiner*—Jay H. Woo
*Attorney, Agent, or Firm*—Armstrong, Nikaido & Marmelstein

[57] ABSTRACT

A process for manufacturing fibers by a wet spinning procedure from an anisotropic dope of a polymer having aromatic mononucleus or polynucleus divalent radicals in which the chain extending bonds from each aromatic nucleus are coaxial or parallel and oppositely directed and which are connected by at least one link selected from —NHCO—, —NHCOCONH— and —CONHNHCO— is provided. The filaments taken out from a coagulation bath are, without applying any substantial tension thereto, washed with water, dried and optionally heat-treated, on a conveyor. The resulting fibers possess moderate initial modulus and elongation as well as high tenacity.

9 Claims, 2 Drawing Figures

PROCESS FOR MANUFACTURING AROMATIC POLYMER FIBERS

Figure 1:
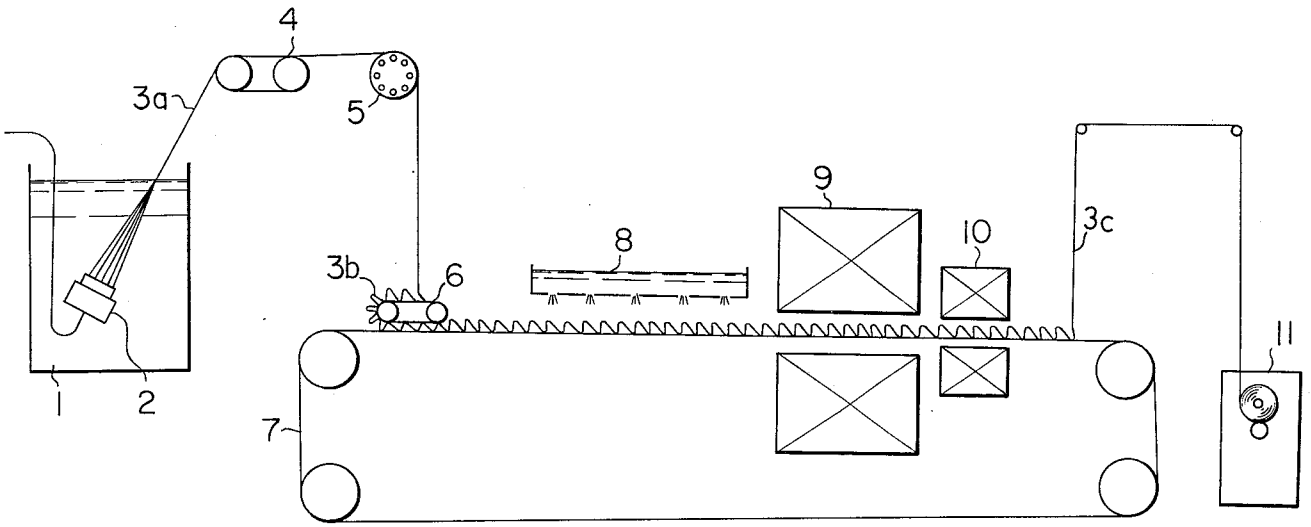

This invention relates to a process for manufacturing fibers possessing a high tenacity and moderate initial modulus and elongation from an anisotropic dope of a specified aromatic polymer.

It is believed that an aromatic polymer, such as poly-p-phenyleneterephthalamide, having aromatic divalent radicals in which the chain extending bonds from each aromatic nucleus are coaxial or parallel and oppositely directed and which are connected by a link, such as an amide link comprising a carbonyl group or groups and a nitrogen atom or atoms, is present in an extended form in its dope. When the polymer is present at a concentration exceeding the critical concentration point in its dope, the extended stiff-chain molecules aggregate in essentially rod-like entities, i.e. micell. This dope is anisotropic and characterized as exhibiting birefringence and depolarizing plane-polarized light in a polarizing microscope. When the dope is subjected to appreciable shear, the extended stiff-chain molecules are more oriented thereby to scatter light and exhibit metal-like or pearl-like luster, that is, at least part of the dope is in the liquid crystalline state.

When the anisotropic dope is extruded through orifices of a spinneret, particularly by a wet spinning procedure, the coagulated filaments exhibit exceptionally enhanced molecular orientation and consequently, change only to a minor extent in their dimension in the courses of washing with water and drying. These filaments possess exceptionally high tensile properties such as tenacity and initial modulus, even when they are not drawn. Such filaments are already known as disclosed in U.S. Pat. No. 3,819,587.

It has been found that if these as-extruded filaments are subjected to appreciable tension in the courses of washing with water and drying, the resulting filaments exhibit exceptionally high initial modulus and low elongation. Such filaments are not advantageous in that they are brittle and poor in flexural fatigue resistance, and the reduction in tenacity when twisted is large. Therefore, these filaments are not suitable for industrial material applications in which toughness is generally required. Further, weaving and plying from these filaments cannot be smoothly carried out, because individual filaments are liable to be cramped or slackened due to their reduced elongation. It is difficult to make these filaments uniform.

It is already known as proposed in Japanese Pat. Publication No. 6415/1973 that an isotropic dope of the specified carbocylic aromatic polymer is spun into filaments by a so-called dry jet wet spinning procedure wherein the dope is once extruded into a gaseous atmosphere and then introduced into a coagulation liquid bath. The as-extruded filaments are washed through a cascade, while being drawn, are dried and finally heat-treated at a temperature higher than 300° C under tension. The resultant filaments are also characterized as possessing enhanced tenacity and initial modulus and reduced elongation. For example, when the filaments exhibit a tenacity exceeding 15 g/d, its elongation is below approximately 4%. Therefore, these filaments are also not satisfactory. If the heat-treatment is carried out at a lower temperature or under lower tension, the resulting filaments exhibit moderate elongation and initial modulus but become extremely poor in tenacity.

Therefore, it is a main object of the present invention to provide fibers possessing high tenacity, controlled, not too high initial modulus and not too low elongation.

Another object of the present invention is to provide a process for manufacturing such fibers.

Other objects and advantages will become apparent from the following description.

In accordance with the present invention, there is provided a process for manufacturing fibers by a wet spinning procedure from an anisotropic dope of an aromatic polymer having aromatic mononucleus or polynucleus divalent radicals in which the chain extending bonds from each aromatic nucleus are substantially coaxial or parallel and oppositely directed and which are connected by at least one link selected from the group consisting of —NHCO—, —NHCOCONH— or —CONHNHCO—, which process comprises the steps of:

making filaments taken out from a coagulation bath, without drawing the filaments, fall onto a conveyor at a rate of more than the linear velocity of the conveyor, and washing with water then drying the filaments on the conveyor without applying any substantial tension to the filaments.

By the term "fibers" used generically herein is meant to include numerous conventional fiber structures. For example, the fibers may be of staple or continuous lengths. Similarly, the fibers may consist of a single component or multicomponents, i.e. a composite fiber with two or more components consisting of different aromatic polymer compositions.

The specified aromatic polymer used in the invention is such that a dope of the polymer in a suitable solvent exhibits anisotropy when the polymer is present in a particular concentration range. Anisotropy of the dope may be determined by optical anisotropy thereof. A qualitative determination of the optical anisotropy may be conveniently made as follows. That is, powdered polymer is sandwiched between two pieces of glass sheets together with a small amount of sulfuric acid. The glass sheets are rubbed together thereby dissolving the polymer. It can be visually observed with the maked eye if opalescent trails are left in the rubbing direction. More exactly, a dope of the polymer is placed between a polarizer and an analyzer, adjusted to provide 90° crossed polarization planes, in a polarizing microscope, and it can be visually observed whether or not the dope changes the dark field to a bright field.

The aromatic polymer used in the invention is characterized by having a molecular structure such that the polymer consists essentially of aromatic mononucleus or polynucleus divalent radicals in which the chain extending bonds from each aromatic nucleus are substantially coaxial or parallel and oppositely directed and are connected by at least one link such as —NHCO—, —NHCOCONH— or —CONHNHCO—. The aromatic mononucleus or polynucleus may be either carbocyclic or heterocyclic. The polynucleus may be either enchained non-fused rings or fused rings.

The aromatic divalent radicals having chain-extending bonds which are coaxial and oppositely directed include, for example, p-phenylene 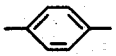

4,4'-biphenylene 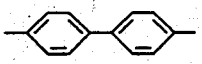

1,4-naphthylene 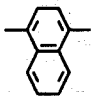 and 2,5-pyridylene 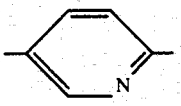

The aromatic divalent radicals having chain-extending bonds which are parallel and oppositely directed include, for example, 1,5-naphthylene 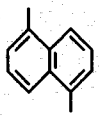 and 2,6-naphthylene 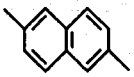

The following are also exemplified as the aromatic divalent radicals used:

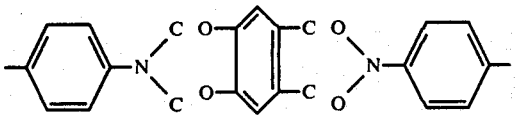

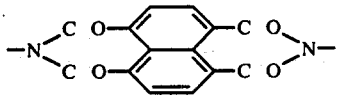 and

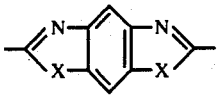

wherein X is selected from the group of —O—, —S— and —NH—.

The following divalent radical of enchained non-fused two rings is also included:

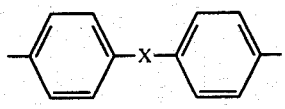

wherein X is composed of two or four enchained atoms such that the divalent radical of this formula exhibits a conjugated system as the whole, and includes, for example, trans —CH=CH—, —N=N—, —CH=N—, —N=N—(→O), —C(=O)—O— and —S(=O)(=O)—N(H)—.

The aromatic divalent radical having the chain-extending bonds coaxial or parallel and oppositely directed may contain one or more inert substituents such as, for example, halogen, lower alkyl, nitro, alkoxy and cyano.

The aromatic divalent radicals having the chain-extending bonds, which are parallel or coaxial and oppositely directed, in the polymer may be partially substituted with other aromatic divalent radicals or aliphatic divalent radicals, provided that the resulting polymer dope is anisotropic. Such other aromatic divalent radicals include, for example, m-phenylene 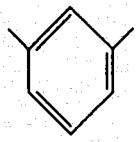 and 4,4'-diphenylmethane 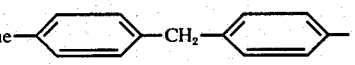

Aliphatic divalent radicals are those which comprise enchained, even numbered carbon atoms and include, for example, 1,2-ethylene —$CH_2$—$CH_2$—,
1,4-butylene —$(CH_2)_4$—,
1,2-propylene —$CH_2$—CH($CH_3$)— and
1,2-butylene —$CH_2$—CH($CH_2$—$CH_3$)—

These divalent radicals should be present in amount of below approximately 5% by mole, based on the total amount of the divalent radicals, in view of anisotropy of the resulting polymer dope.

The aromatic divalent radical having such chain-extending bonds may be present alone or in combination in a polymer.

The links connecting the afore-said aromatic divalent radicals comprise a combination of —NH— and —CO—. In order to provide the desired straight linear molecular chain, the links should be substantially composed of even numbered, enchained atoms, such as —NHCO—, —NHCOCONH— or —CONHNHCO—. These linkages may be present either along or in combination in a polymer. Links composed of odd numbered, enchained atoms such as the urea link —NHCONH— and the urethane link —NHCO—O— may be present in an amount of below approximately 5% by mole, provided that the resulting polymer dope is anisotropic. A link of the formula —CONHNHCO— is sometimes dehydrated thereby being converted into a closed ring of the formula

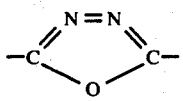

when the polymer is exposed to a high temperature while in the preparation of dope or in the spinning of dope. However, such a closed ring link may also be serviceable.

Illustrative of polymers which are substantially comprised of the above-mentioned aromatic divalent radicals connected by the above-mentioned link are poly-p-phenylene terephthalamide, poly-p-benzamide, polyterephthaloylhydrazide, poly-p-phenylene succinylamide, copoly-p-phenylene terephthalamide/ terephthaloylhydrazide, copoly-4,4′ -biphenylene/p-phenylene terephthalamide,

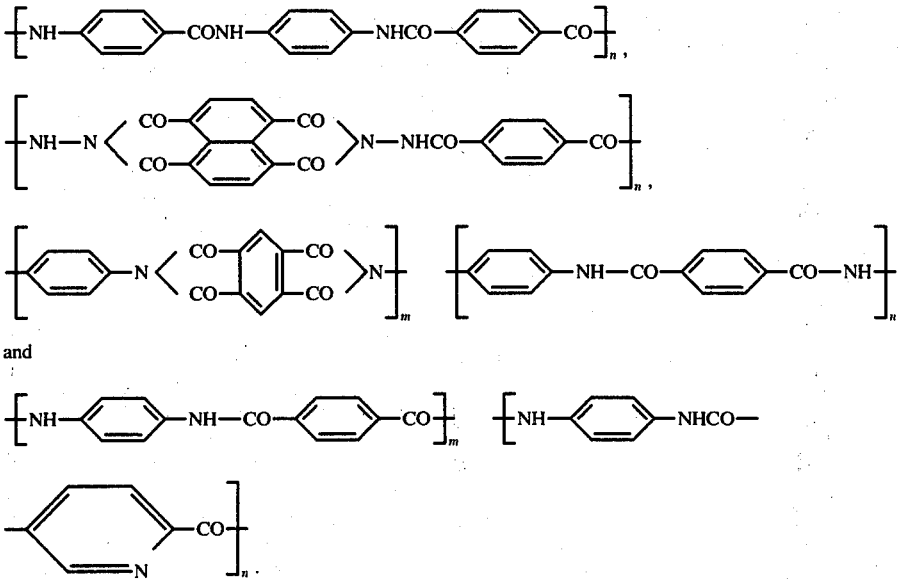

and

Besides the above-listed polymers, many polymers may be employed which are substantially comprised of the aromatic divalent radicals, hereinbefore specified, connected by the link hereinbefore specified.

The polymer used may be either a homopolymer or a copolymer. The copolymer may be ordered, random or block. These polymers may be used along or as blends.

The polymers may be prepared in known manners from a suitable combination of diamine, dicarboxylic acid, aminocarboxylic acid, amino hydrazide and dihydrazide, each containing the specified aromatic divalent radicals, and oxalic acid. For example, the following procedures may be adopted. First, a carboxyl group is converted into an acid halide, acid imidazolide or ester group and then, reacted with an amino group and/or a hydrazide group. Second, an amino group is converted into an isocyanate group and then, reacted with a carboxyl group. Or, these procedures may be combined.

The polymerization may be performed by any known procedure such as, for example, low temperature solution polymerization, high temperature solution polymerization, interfacial polymerization, melt polymerization, solid phase polymerization and heat transfer medium polymerization. Of these procedures, solution polymerization, interfacial polymerization and a combination of the two are preferable because these procedures readily result in polymers having a particularly high molecular weight.

The degree of polymerization in polymers used in the invention may be varied in broad ranges. However, when the degree of polymerization is excessively low, the polymer results in fibers which are poor in tenacity and toughness. Therefore, it is preferable that the degree of polymerization is at least 3.0, especially at least 4.5, in terms of inherent viscosity $\eta$ inh as measured by a procedure hereinafter defined.

Polymers previously described are dissolved in asuitable solvent to form spinning dopes. The suitable solvent refers to that which is capable of dissolving the polymer at a particular concentration range in which the dope is anisotropic. The suitable solvent is dependent upon the particular aromatic polymer used. In general, solvents useful for forming the anisotropic dopes of the invention include, for example, selected amides and ureas such as dimethylacetamide, N-methypyrrolidone, tetramethylurea and hexamethylphosphoramide, and dimethylsulfoxide and tetramethylene sulfonic acid, which may preferably contain small amounts of lithium chloride and/or calcium chloride. These may be used either alone or in combination. Other useful solvents are concentrated sulfuric acid, chlorosulfuric acid, fluorosulfuric acid and mixtures thereof. Of these, sulfuric acid having a concentration of more than 98% and oleum, i.e. concentrated sulfuric acid containing up to 20% of free $SO_2$, are most preferable because these sulfuric acids cost less, are commercially available and provide dopes having a higher polymer concentration. If desired, hydrogen fluoride, halogenated alkylsulfonic acid, halogenated aromatic-sulfonic acid and tri-halogenated acetic acid may be used in combination with the above-specified solvents.

Conventional stirring means may be employed for dissolving the aromatic polymers in solvents. The aromatic polymers combined with solvents may be stirred at a low temperature in order to avoid the thermal degradation of polymer or at an elevated temperature in order to accelerate the dissolution or produce dopes of high concentration. Concentrated sulfuric acid tends, at a high temperature, to cause sulfonation of polymer or shearing of its molecular chain. Therefore, it is preferable that the dopes from concentrated sulfuric acid are prepared, reserved and used at a temperature of 40° to 50° C or lower. However, when such dopes are prepared and spun into filaments within a relatively short time period, e.g. within several hours to a dozen hours, and the polymer is permitted to be reduced in the polymerization degree to a minor extent, the dopes are maintained at a temperature up to approximately 100° C.

The concentration of polymer in a dope should be more than or equal to the critical concentration point so that the dope is anisotropic. If the concentration of polymer is lower than the critical concentration point, i.e. the dope is isotropic, filaments spun therefrom are liable to change in dimension while being subjected to treatment such as washing with water and drying under no tension in the process of the invention. This results in filaments which are partially cramped and loosened and which have reduced tenacity. The suitable concentration of polymer for the anisotropic dope depends upon the particular solvent, the polymerization degree of polymer, the temperature of the dope and, upon occasion, the particular type of polymer used. In general, such suitable concentrations are more than several % by weight in the case of most solvents, and 10% or more in the case of solvents exhibiting high solubility such as concentrated sulfuric acid.

The more the concentration of polymer in a dope, the higher the tenacity of the resulting fibers. Therefore, in order to provide fibers of improved tenacity, it is in general, preferable that the concentration of polymer is more than approximately 15% by weight, and preferably more than 17% by weight. Any high concentration of polymer up to the possible maximum concentration may be employed. For example, a concentration of approximately 30 to approximately 50% by weight may be employed provided that powdered polymer impregnated with solvent is heated and extruded using, for example, an extruder.

The dope prepared is, if desired, filtered and deaerated using known manners. Then, the dope is spun into mono- or multi-filaments by a wet spinning procedure. Conventional wet spinning procedures and apparatus may be employed. Instead of extruding a dope directly into a coagulation bath as shown in FIG. 1, a dope may be extruded into a non-coagulating gaseous atmosphere such as the air and immediately thereafter, be introduced into a coagulation bath. This procedure, which is popularly called a dry jet wet spinning procedure, is similarly preferable because it is performed without applying any substantial tension to the filaments while they are coagulated. The filaments taken out from a coagulation bath are made to fall onto a conveyor where the filaments are washed with water, dried and, if desired, heat-treated, without applying any substantial tension to the filaments.

Figure 2:
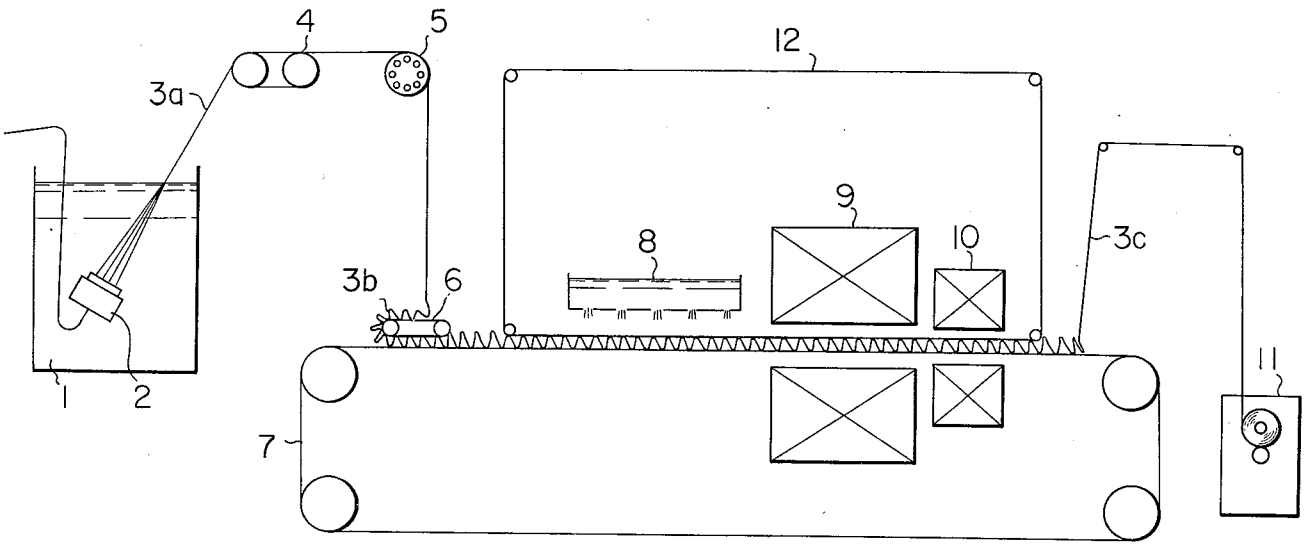

The procedure whereby the filaments are washed with water, dried and heat-treated will be illustrated in detail with reference to the accompanying drawings, in which FIG. 1 is a preferable embodiment of the arrangement employed in the practice of the invention, and FIG. 2 is a modification of the arrangement shown in FIG. 1.

In FIG. 1, an anisotropic dope of the specified aromatic polymer is extruded into a coagulation bath through a spinneret 2. The coagulated filaments 3*a* are taken from the coagulation bath by take-up rollers 4 and made to fall onto a conveyor 6 by a cage roller 5. The cage roller 5 has a cage-like appearance and is composed of a plurality of rods which constitute the filament-guiding periphery. The filaments are formed into an endless, narrow fleece of piled, loose filaments 3*b* on the conveyor 6 and are transferred onto a conveyor 7 while being turned over. The conveyor 7 is moved continuously or intermittently by a suitable driving means (not shown) at a velocity substantially equal to that of the conveyor 6. The fleece of piled, loose filaments 3*b* travel together with the conveyor 7 through a washing apparatus 8, a drying apparatus 9 and then a heat-treating apparatus 10. Then, the filaments 3*c* are taken up from the conveyor 7 and are wound around a bobbin by a winding apparatus 11.

The coagulation liquid is not critical and may be selected from those which are conventionally used for the particular combination of the aromatic polymer and the solvent. A mixture of the solvent used for the preparation of dope and water is preferable from a standpoint of its recovery. The coagulation bath may be maintained at any desired temperature, usually selected between −5° C to 70° C.

A taking up means such as rollers 4 shown in FIG. 1 may be omitted provided that the means for making the coagulated filaments fall onto the conveyor exerts the function of taking out the filaments from the coagulation bath.

No substantial tension should be applied to the filaments while they are being taken from the coagulation bath and fall onto the conveyor. If coagulated but not yet dried filaments are drawn as is conventionally carried out in the production of most wet-spun synthetic polymer filaments and regenerated cellulose filaments, the resulting filaments exhibit undesirably enhanced initial modulus and reduced elongation. Further, such drawing results in reduction in tenacity of filaments to a small extent. It is, however, impossible to completely avoid the application of slight tension to coagulated filaments because the filaments must be taken from the coagulation bath and made to fall onto the conveyor by the friction of the roller. Thus, the term "without applying substantial tension" used herein refers to the fact that the tension is below approximately 0.5 g, and preferably below approximately 0.2 g, per denier of the filaments.

Instead of the single cage roller 5 shown in FIG. 1, a pair of similar cage rollers, a single gear roller or a pair of gear rollers may be employed, which are driven at a peripheral speed approximately equal to or slightly faster than the travelling speed of the filaments. Other means such as an ejector utilizing a fluid stream and an air-sucker exerting sucking force may be used. It is also possible to make together with a water stream the filaments fall onto the conveyor. Both the taking up rollers 4 and the roller 5 may be omitted, for example, when coagulated filaments are taken from a coagulation bath together with the coagulation liquid by using a coagulation vessel fitted with a funnel tube as conventionally used in the spinning of cuprammonium rayon.

Instead of the conveyor 6 shown in FIG. 1, a roller may be used, onto the periphery of which a bundle of filaments is made to fall.

It is preferable that the filaments are made to fall onto the conveyor 6 and then, transferred onto the conveyor 7 while being turned over, as illustrated with reference to FIG. 1, because the filaments *3c* can be smoothly taken from the conveyor 7 without entanglement or fluff-formation in the filaments. However, the conveyor 6 onto which the filaments fall, may be omitted, provided that other suitable means for turning over the filament fleece is employed. The conveyor 6 or a roller is usually driven at a speed approximately equal to that of the conveyor 7. However, the speeds of the conveyor 6 or a roller may be suitably varied depending upon the intended thickness of the fleece of piled, loose filaments on the conveyor 7, and the material and shape of the conveyor 6 or roller. The conveyor 6 may be made of a rubber sheet, a wire net, a net or woven or knitted fabric of polyvinylidene chloride fiber or other synthetic fibers. The roller may be made of metal or plastic such as polyvinyl chloride. The roller may be coated with rubbery material or closely covered with the net or with the woven or knitted fabric described above.

The conveyor 7 has a structure such that washing water and other treating liquids are capable of passing therethrough or penetrating thereinto. Such a structure includes, for example, net, woven fabrics, knitted fabrics and a plurality of perforated plates connected in series. The conveyor is made of material which is resistant to the coagulation liquid and the treating liquid and preferably possesses good dimensional stability. Such material includes, for example, stainless steel wire nets or perforated sheets, woven or knitted fabrics of glass fibers, glass fiber nets coated with fluoroplastics, woven or knitted fabrics of fluoroplastic fibers and perforated sheets or plates of fluoroplastics.

The speed of the conveyor 7 is less than that of the filaments falling onto said conveyor. The over feed ratio, i.e. the ratio of the filament speed to the conveyor speed, is preferably in the range from approximately 12 to approximately 10,000, more preferably in the range from approximately 100 to approximately 2,000. When the over feed ratio is less than approximately 12, the filaments are liable to be subjected to appreciable tension while being washed with water, dried and heat-treated.

The thickness of the narrow fleece of piled, loose filaments may be varied depending upon the over feed ratio set forth above the width of the fleece. Usually, the thickness is within the range of 2 mm to 20 mm. When the fleece is too thin, the filaments are liable to be disheveled and tangled by streams of washing water and streams of drying hot air and therefore, the filaments are partially subjected to appreciable tension while being washed with water and dried. This produces in equality in mechanical properties particularly tenacity between individual filaments.

The areal density of the fleece of piled, loose filaments on the conveyor may be varied by the aforesaid over feed ratio and the width of the fleece. The areal density is within the range from 0.005 to 0.2 g/cm, preferably within the range from 0.12 to 0.15 g/cm, both based on the dry wight.

The width of the filament fleece laid on the conveyor 7 may be controlled, for example, by varying the distance from the roller 5 to the conveyor 6 or 7, providing a yarn traverser either upstream to or downstream from the roller 5, or providing a traversing chute downstream from the roller 5. Although the suitable width of the filament fleece varies depending upon the total fineness of the filaments and initial modulus thereof, it is usually within the range from several mm to dozens of cm and may be on occasion approximately 1 m. It is possible to make a plurality of bundles of filaments, instead of a single bundle of filaments, fall onto the conveyor 6 or 7 to form rows of narrow fleeces of piled, loose filaments at intervals of approximately 1 mm to several cm.

The filament fleece laid on the conveyor 7 is first washed with water. The method and apparatus whereby wet-spun filaments are washed with water on a continuously moving conveyor without applying any substantial tension to the filaments are known in the art as described in U.S. Pat. Nos. 3,672,819; 3,689,620; 3,765,818, and 3,781,950.

The manner whereby washing water is supplied onto the filament fleece is not critical. For example, water may be showered through a perforated plate or finely sprayed by an atomizer, or made to flow down along a plurality of bristles. The washing water supplied onto the filament fleece passes through the filament fleece thereby removing the coagulation liquid remaining in the filament fleece and the solvent remaining therein and passes through the conveyor. The washing is carried out preferably until the content of solvent remaining in the filaments decreases to below 5,000 ppm in the case of an organic solvent and below 1,000 ppm in the case of an inorganic solvent.

If desired, a treating liquid such as the same as the coagulation liquid, a mixture of the coagulation liquid and water or neutralizing agent may be supplied onto the filaments upstream of the washing in order to complete the coagulation or recover the coagulation liquid.

One or more pairs of squeeze rollers may be provided upstream of or within the washing zone for facilitating the washing or downstream of to the washing zone for facilitating the succeeding drying. If desired, a suction means for sucking the washing water may be provided at the lower side of the conveyor.

The washed filament fleece is dried without supplying any substantial tension thereto. The drying temperature is usually 50° to 400° C, preferably 70° to 250° C and more preferably 70° to 200° C. When the drying is carried out in an inert gas atmosphere such as nitrogen or combustion gas, the temperature may be elevated to, for example, 400° to 600° C. The heating means for drying the filaments may be conventional such as far-infrared heater, infrared lamp, heated plate, high frequency heater and hot-air oven. The drying zone may be divided into two or more zones.

Additives may be added to the filaments upstream of, downstream from and/or within the drying zone. The additives include, for example, oiling agents such as antistatic agent and lubricant, colorant and adhesive.

When it is desired to improve the stability in dimension and mechanical properties at high temperatues, the dried filaments are heat-treated. The heat treatment is also carried out without applying any substantial tension to the filaments. The manner whereby the heat treatment is carried out is not critical. Conventional heating means may be employed such as those illustrated with reference to drying.

The heat-treating temperature may be suitably selected in the range from 200° C to 600° C, depending upon the particular polymer and the desired dimensional stability and mechanical properties' stability. The heat-treating period is usually within the range from approximately 10 seconds to 5 minutes. The heat treatment is advantageously performed in an inert gas atmosphere such as nitrogen.

When the piled, loose filaments are liable to be disheveled and the individual filaments are liable to be entangled with each other by the washing water, hot-air for drying or the fact that the filaments are electrostatically charged, a covering endless belt 12 is preferably provided as shown in FIG. 2. The covering belt 12 sandwiches the filament fleece together with the conveyor 7 to prevent the filaments from being disheveled. The covering belt 12 travels at the same speed as the conveyor 7 and imparts no tension to the filaments.Instead of a single covering belt 12 extending over the entire zones of washing, drying and heat-treatment as shown in FIG. 2, two or more covering belts may be provided each covering at least one zone of the washing, drying and heat-treatment zones. The covering belt may be a net, a woven or non-woven, or knitted fabric or other similar structure set forth with reference to the conveyor belt 7, which is preferably made of, for example, polyesters, polypropylene, aromatic polyamides and cross-linked phenolformaldehyde resin and other synthetic polymers.

Instead of the covering endless belt, it is possible to treat the filaments by fluid ejection prior to their falling on the conveyor, thereby to entangle the individual filaments to minor extents. This treatment also serves to prevent the filaments from being disheveled on the conveyor during washing, drying, and heat-treatment.

The dried and optionally heat-treated filaments are separated from the conveyor and wound into rolls such as a pirn, cone or cheeze. Filament detecting means such as a photoelectric detector may be provided in order to check the point where the filaments are separated from the conveyor and, thus, control the speed of filament winding. If desired, a humidifier such as a steam box or a water supplying roller may be provided upstream of the winding apparatus.

The advantages of the present invention may be summarized as follows.

1. No substantial tension is applied to filaments during the entire course of their manufacture. Thus, the resultant filaments exhibit the desired, moderate elongation and initial modulus as well as improved tenacity. The elongation is usually at least 4% and preferably at least 5%. The initial modulus is usually below 600 g/d, preferably 450 g/d and more preferably below 350 g/d.

It is surprising that the filaments exhibit tenacity higher than that of the filaments which are manufactured by a method wherein the coagulated filaments are washed, dried and optionally heated, under tension.

2. A yarn of the fibers of the invention provides, when twisted, a twisted yarn exhibiting a tenacity lower only to a slight extent than the untwisted yarn. In contrast, an aromatic polymer fiber yarn manufactured by a conventional procedure results in a twisted yarn of far reduced tenacity.

The tenacity of the twisted yarn of fibers of the invention is readily improved by heating the twisted yarn under tension. In contrast, it is difficult to improve to an acceptable level the tenacity of the twisted yarn of conventional aromatic polymer fibers by heat-treatment under tension. This is because a far greater tension, usually in excess of approximately 1 g/d, is required and, therefore, when a cord fabric for tire cords is treated, a tension of a dozen tons is required in total.

3. The fibers of the invention exhibit good compression-extention fatigue property. Further, they are excellent in compressional modulus, although they possess rather low initial modulus in tension.

4. There is no substantial inequality in mechanical properties between individual filaments or between bundles of filaments.

5. Concentration of solvent in a coagulation bath may be increased advantageously to a high level.

6. Filaments having increased denier in single filament denier or the total filament denier are advantageously manufactured.

The fibers of the invention are useful as industrial materials such as tire cords and other cords for reinforcing V-belt, flat belt and braided hose; as well as rope, hose, belt, bag filter and sewing thread for high-speed sewing machine. They are also useful as woven or knitted fabric for clothing, covering material or interior decoration.

The following examples are given to illustrate the invention and are not be be considered as limiting in any sense. In the examples, parts and percentages are by weight, unless otherwise specified.

Inherent viscosity $\eta$ inh, which is a measure for the polymerization degree of polymer, refers to, unless otherwise specified, that which was determined on a polymer solution having a concentration of 0.3 g per 100 ml of 98% sulfuric acid at 30° C.

Tenacity, elongation and initial modulus are conveniently measured in accordance with Japanese Industrial Standard L-1017, using a tensile testing machine providing constant rate of extension, at a rate of extension of 50%/minute and at a grip length of 20 cm. Filament specimens were twisted at 8 turns per 10 cm length prior to testing. The afore-said tensile properties were determined from load-elongation curves. Results were reported as an average value of 20 specimens.

Thickness of the fleece of piled, loose filaments on the conveyor means an average thickness measured along the center line, i.e. the ridge, of the filament fleece extending in the travelling direction, which filament fleece is washed but not yet dried. Areal density of the filament fleece means that expressed on the dry base.

In the examples, monomers and solvents used were coded as follows; terephthaloyl chloride = TPC, terephthalic dihydrazide = TDH, p-phenylenediamine = PPDA, hexamethylphosphoramide = HMPA, N-methylpyrrolidone = NMP, N,N-dimethylacetamide = DMAc and dimethylsulfoxide = DMSO.

REFERENCE EXAMPLE

This example illustrates the preparation of polymers and the determination of anisotropic dopes thereof.

POLYMER PREPARATION

POLYMER A 378 g of PPDA was dissolved in 10 liters of a mixture of 2 parts HMPA and 1 part NMP, followed by cooling to 10° C. 710 g of powdered TPC was added at once to the solution. The polymerization mixture gelled into the form of cheese within several minutes. A semi-solid mass so obtained was combined with approximately the same amount of water and pulverized using a Henschel mixer. The pulverized product was filtered, washed three times with warm water and then dried by hot air at 110° C. 830 g of light yellow polymer in the form of sawdust was obtained (poly-p-phenylene terephthalamide, hereinafter referred to as "polymer A" for brevity). The inherent viscosity $\eta$ inh was 5.9.

POLYMER B 582 g of TDH was dissolved at an elevated temperature in 10 liters of HMPA containing 10% of LiCl, followed by cooling to room temperature. 609 g of powdered TPC was added to the solution. A white gelled, solid mass was formed in an hour. The solid mass was treated in a manner similar to that in the preparation of polymer A to prepare 485 g of finely divided polymer (polyterephthaloyl hydrazide, hereinafter referred to as "polymer B" for brevity). The inherent viscosity $\eta_{inh}$ was 2.3 as measured in DMSO.

POLYMER C

Following the procedure for the preparation of polymer A, poly-p-phenylene isocinchomeronamide (hereinafter referred to as "polymer C" for brevity) was prepared wherein isocinchomeronic acid dichloride was used instead of TPC with all other conditions remaining substantially the same. Polymer C was yellowish brown and had an inherent viscosity $\eta_{inh}$ of 4.8.

POLYMER D 324 g of PPDA was dissolved in 10 liters of HMPA. 196 g of powdered pyromellitic anhydride was added to the solution at room temperature. Then, 426 g of powdered TPC was added to the solution to effect polymerization. The product was pulverized in methanol to obtain a finely divided polymer. The polymer was treated with acetic anhydride to prepare copoly-p-phenylene terephthalamide-pyromellitimide (hereinafter referred to as "polymer D" for brevity). The inherent viscosity $\eta_{inh}$ was 4.0.

POLYMER E 259 g of PPDA and 127 g of o-tolidine were dissolved in 10 liters of DMAc containing 5% of LiCl. 609 g of powdered TPC was added to the solution at room temperature. A gelled, solid mass formed was treated in a manner similar to that in the preparation of polymer A to prepare copoly-4,4'- -biphenylene-p-phenylene terephthalamide (hereinafter referred to as "polymer E" for brevity). The inherent viscosity. $\eta_{inh}$ was 3.8.

ANISOTROPIC DOPE DETERMINATION

A qualitative determination of polymer dopes was conveniently made as follows. Each polymer was dissolved in 99.5% sulfuric acid. A small amount of the sulfuric acid dope on a slide glass was placed between analyzer and polarizer, and was adjusted to provide 90° crossed polarization planes in a polarizing microscope. It was observed whether or not light was transmitted, i.e. a bright field was produced.

Polymer A proved to be capable of forming a dope exhibiting anisotropy at a concentration of higher than approximately 9.8%. Concentration of the anisotropic dope was capable of being raised to approximately 15% at room temperature and to approximately 20% at an elevated temperature. When the dope was allowed to stand at an elevated temperature, polymer A appeared to be degraded, and one day later, the viscosity of dope decreased and the anisotropy disappeared. However, the dope of an elevated temperature was capable of being formed into fully acceptable filaments when it was spun within a relatively short period of time after its preparation.

Polymer B was capable of forming an anisotropic dope at a concentration of higher than approximately 10%. However, the anisotropy disappeared when left at room temperature for two days.

Polymer C exhibited anisotropy approximately similar to polymer A.

Polymer D was capable of forming an anisotropic dope at a concentration of higher than approximately 10%. The concentration was capable of being raised to approximately 17%.

Polymer E was capable of forming an anisotropic dope at a concentration of higher than approximately 9.5%. Even when a dope of 14% concentration was allowed to stand at 40° C for about three days, the dope was anisotropic and capable of being spun into filaments.

EXAMPLE 1

Following the procedure for the preparation of polymer A, a polymer was prepared wherein the preparation scale was enlarged with all other conditions remaining substantially the same. The polymer (hereinafter referred to as "polymer A'") had a inherent viscosity $\eta_{inh}$ of 6.1.

Polymer A' was stirred in 99.3% sulfuric acid at 70° C in vacuo for two hours, allowed to stand for two hours and then, deaerated to prepare a dope of 18% concentration. The dope was extruded through a spinneret with 800 orifices each having a diameter of 0.06 mm. The extrudate travelled 10 mm through the air and successively travelled through a coagulation bath of 30% aqueous sulfuric acid maintained at 3° C. The filaments so formed were taken out at a rate of 100 m/min. Then, the filaments were washed with water, dried and heat-treated by using an apparatus as shown in FIG. 2, wherein the speed of the filaments falling onto the conveyor was 100 m/min., the speed of the conveyor was 1 m/min., and the thickness, areal density and width of the filament fleece on the conveyor were 6.3 mm, 0.027 g/cm$^2$ and 50 mm, respectively. The drying was carried out by hot air at 120° C and the heat treatment was carried by a heated plate at 220° C. A cover belt of a plain weave fabric of polytetrafluoroethylene fibers was used.

The heat-treated filaments (A) had a fineness of 1,200 denier, a tenacity of 21.5 g/d, an elongation of 6.4% and an initial modulus of 355 g/d. The dried filaments (B) which were not subjected to the afore-said heat treatment had a fineness of 1,200 denier, a tenacity of 21.3 g/d, an elongation of 6.8% and an initial modulus 330 g/d.

Both the heat-treated filaments (A) and the unheat-treated filaments (B) were heated at 200° C in an oven under a tension of 0.5 g/d. The resulting filaments (A) and (B) exhibited tenacities of 21.0 g/d and 21.2 g/d, elongations of 6.2% and 3.3%, and initial moduli of 370 g/d and 650 g/d, respectively. These results substantiate that the filaments produced by the process of the invention exhibit tensile properties approximately similar to those which are not subjected to such after-heat treatment.

For comparison purposes, the afore-said procedure for the production of filaments was repeated wherein the filaments taken out from the coagulation bath was, instead of using an apparatus as shown in FIG. 2, washed in a water bath, dried in a tunnel drier and then, heat-treated on a heated plate at 220° C. In the water bath, water was forced to flow in a countercurrent manner to the travelling filaments, and in the tunnel drier hot air of 150° C was forced to circulate. In these arrangements, delivery rollers were fitted at the inlet of the water bath, between the water bath and the drier, at the outlet of the drier and downstream from the heated plate. These rollers were driven at controlled rates so that any tension, other than those generated by the countercurrent flow of water and filament guides, is given to the filaments to the smallest extent possible.

The heat-treated filaments had a fineness of 1,150 denier, a tenacity of 17.0 g/d, an elongation of 2.5% and an initial modulus of 680 g/d. The dried filaments which were not subjected to the heat treatment had a fineness of 1180 denier, a tenacity of 17.5 g/d, an elongation of 3.4% and an initial modulus of 555 g/d. These filaments are poor in tenacity and elongation and possess high initial modulus as compared to the filaments obtained by the process of the invention.

EXAMPLE 2

Following the procedure set forth in Example 1, a spinning dope of polymer A′ similar to that used in Example 1 was spun into filaments using 10 spinning apparatuses each fitted with a spinneret having 200 orifices each with a diameter of 0.055 mm. The 10 bundles of filaments so formed were taken out in parallel from a coagulation bath and treated by using an apparatus as shown in FIG. 2, wherein the speed of each bundle falling onto the conveyor was 100 m/min., the speed of the conveyor was 0.3 m/min., and the thickness and areal density of each filament fleece on the conveyor were 7.5 mm and 0.03 g/cm$^2$ , respectively. That is, the 10 strands of filaments fell onto conveyor 6 to form 10 fleeces of piled, loose filaments on conveyor 7, and washed with water, dried, heat-treated, and then, wound up separately. Each filament fleece was in parallel to each other at intervals of 5 mm on the conveyor 7. The width of each filament fleece was 50 mm. The washing time was approximately 20 minutes. The drying and heat-treatment were carried out by hot air at 170° C and 250° C, respectively.

The heat-treated 10 bundles of filaments had an average fineness of 400 denier, tenacities of 21.4 g/d (minimum) to 22.5 g/d (maximum), elongations of 5.8% (minimum) to 6.5% (maximum) and initial moduli of 345 g/d (minimum) to 380 g/d (maximum). The dried strands of filaments which were not subjected to said heat treatment had tenacities of 21.5 g/d (minimum) to 22.8 g/d (maximum), elongations of 6.4% (minimum) to 7.0% (maximum) and initial moduli of 425 g/d (minimum) to 465 g/d (maximum). These results show that there is no great difference between bundles in their tensile properties.

For comparison purposes, the afore-said procedure was repeated wherein the 10 bundles of filaments were washed in a water bath, dried in a tunnel drier and then heat-treated on a heated plate in manners similar to those set forth in Example 1 wherein the 10 bundles of filaments travelled in parallel at intervals of 10 mm and separately wound up.

Said 10 heat-treated bundles of filaments had tenacities of 13.1 g/d (minimum) to 17.0 g/d (maximum), elongations of 2.3% (minimum) to 3.4% (maximum) and initial moduli of 520 g/d (minimum) to 680 g/d (maximum). The dried bundles of filaments which were not subjected to said heat treatment had tenacities of 13.7 g/d (minimum) to 18.5 g/d (maximum), elongations of 2.6% (minimum) to 4.0% (maximum) and initial moduli of 500 g/d (minimum) of 650 g/d (maximum). These results show that these filaments are inferior in tensile properties to filaments produced by the process of the invention and that there is a great difference in tensile properties between the bundles of filaments produced at the same time.

EXAMPLE 3

Following the procedure for the preparation of polymer E, a polymer was prepared wherein the preparation scale was enlarged with all other conditions remaining substantially the same. The polymer (hereinafter referred to as "polymer E′") had an inherent viscosity $\eta_{inh}$ of 4.1.

Polymer E′ was stirred in 99% sulfuric acid at 40° C, deaerated and filtered to prepare a dope of 14% concentration. The dope was extruded in a known manner through a spinneret with 1,000 orifices each having a diameter of 0.055 mm, into a coagulation bath of 40% aqueous sulfuric acid maintained at 40° C. The filaments so formed were taken out at a rate of 15 m/min, and treated by using an apparatus similar to that shown in FIG. 1. The filaments fell at a rate of 15 m/min onto conveyor 6 by a pair of nip gear rollers and turned over on conveyor 7. The speed of conveyor 7 was 0.1 m/min. The thickness, areal density and width of the filament fleece were 9 mm, 0.038 g/cm$^2$ and 50 mm, respectively. The filaments on conveyor 7 were washed with water, treated with an oiling agent applied thereto, dried by hot air at 200° C, heat-treated under an atmosphere of nitrogen on a heated plate maintained at 400° C, and then wound up. The filaments neither shrunk nor extended to any appreciable extent on conveyor 7. Both the width and the areal density of the filaments were not changed to any appreciable extent on conveyor 7. The filaments were smoothly wound up without entanglement between individual filaments or loop formation in individual filaments.

The heat-treated filaments had a fineness of 1,800 denier, a tenacity of 18 g/d, an elongation of 3.8% and an initial modulus of 480 g/d. The dried filaments which were not subjected to said heat treatment had a tenacity of 13 g/d, an elongation of 4.2% and an initial modulus of 350 g/d.

COMPARATIVE EXAMPLE 1

Using polymer E′ set forth in Example 3, a dope of 6% concentration in 99% sulfuric acid was prepared. This dope was isotropic and characterized by being transparent both while in the relaxed state and when subjected to appreciable shear.

In contrast, the dope prepared in Example 1 was characterized by being translucent while in the relaxed state, and being completely opaque and exhibiting metal-like luster when subjected to appreciable shear.

Following the procedure set forth in Example 3, filaments were manufactured from the afore-said isotropic dope with all other conditions remaining substantially the same. The filaments shrunk and their width narrowed to appreciable extents while on conveyor 7. The piled filaments were dishevelled. The filaments could not be smoothly wound up, the individual filaments were entangled and many loops were formed on these filaments when wound up.

The heat-treated filaments had a tenacity of 2.8 g/d, an elongation of 80% and an initial modulus of 98 g/d. The filaments which were dried but not yet heat-treated, had a tenacity of 4.8 g/d, an elongation of 60% and an initial modulus of 102 g/d.

For comparison purposes, the afore-said procedure was repeated wherein the filaments taken from the coagulation bath were washed in a water bath, dried in a tunnel drier and then heat-treated on a heated plate in manners similar to those set forth in Example 1. The resultant filaments had a tenacity of 5.2 g/d, an elongation of 25% and an initial modulus of 160 g/d. These results show that, when filaments are manufactured from an isotropic dope by a manner similar to that in the process of the invention, i.e. such that the filaments were dried and heat-treated without any tension applied thereto, the resulting filaments possess reduced tenacity and increased elongation. Further, the filaments from an isotropic dope are similarly poor in tenacity whether or not they are treated with tension applied thereto.

COMPARATIVE EXAMPLE 2

Following the procedure set forth in Example 1, filaments were manufactured wherein the dryer 9 in FIG. 2 was not operated, i.e. the wet filaments on the conveyor 7 were wound round a stainless steel bobbin, and the wet filaments, while being drawn out from the bobbin, were dried in a tunnel drier similar to that used in the comparison test in Example 1, in which hot air of 150° C was forced to circulate. Feed rollers were provided at the inlet and outlet of the tunnel drier whereby the filaments travelled through the drier at a slight tension such that the filaments were neither hung slack nor drawn.

The dried filaments had a fineness of 1,800 denier, a tenacity of 18.3 g/d, an elongation of 3.5% and an initial modulus of 550 g/d. That is, these filaments possessed lower tenacity and elongation and higher initial modulus, than the dried but not yet heat-treated filaments which have been prepared in Example 1 and fall within the invention.

EXAMPLE 4

Polymer D set forth in the Reference Example was dissolved in 98.5% sulfuric acid and deaerated to prepare an anisotropic dope of 20% concentration. The dope was extruded into filaments through a tantalum spinneret with 100 orifices, each having a diameter of 0.06 mm, in a manner similar to that in Example 1 except that an ice water bath was employed as a coagulation bath instead of the aqueous sulfuric acid solution. The filaments were washed with water, dried and then heat-treated at 300° C in a manner similar to that in Example 1, wherein the speed of the filaments falling onto conveyor 6 was 150 m/min, the speed of conveyor 7 was 0.15 m/min, and the thickness, areal density and width of the filament fleece were 11 mm, 0.144 g/cm$^2$ and 45 mm, respectively.

The heat-treated filaments were reddesh brown and had a fineness of 180 denier, a tenacity of 18.0 g/d, an elongation of 4.1% and initial modulus of 450 g/d. The filaments, dried but not yet heat-treated, had a fineness of 180 denier, a tenacity of 18.2 g/d, an elongation of 4.3% and an initial modulus of 480 g/d.

For comparison purposes, the afore-said procedure was repeated wherein the filaments taken from the coagulation bath were washed with water, dried and then heat-treated by using an apparatus fitted with Nelson-type rollers which apparatus is similar to that employed for continuous scouring of artificial filaments such as high tenacity rayon. This apparatus allowed the filaments to travel at a constant rate without shrinkage or extension.

The heat-treated filaments had a fineness of 178 denier, a tenacity of 14.9 g/d, an elongation of 2.4% and initial modulus of 620 g/d. The filaments, dried but not yet heat-treated, had a fineness of 178 denier, a tenacity of 16.9 g/d, an elongation of 3.3% and an initial modulus of 520 g/d.

EXAMPLE 5

11.6 parts of TDH was dissolved in 1,000 parts of HMPA at 70° C. Then, 25.9 parts of PPDA was dissolved in the solution at room temperature, followed by cooling to 10° C in an ice water bath. 60.9 parts of powdered TPC was added at once to the cooled solution. The solution gradually increased in viscosity and finally changed into a gelled, solid mass. The solid mass was treated in a manner similar to that set forth in the preparation of polymer A to prepare copolyamidehydrazide. This polymer was white and had an inherent viscosity $\eta_{inh}$ of 5.0.

The afore-said polymer was dissolved in 99.5% sulfuric acid to prepare a dope of 12% concentration. The dope was anisotropic, i.e. became translucent and exhibited somewhat dull, metal-like luster when stirred. When the dope was allowed to stand for a few hours, it did not change and the polymer was not degraded. However, when the dope was allowed to stand for 2 days, the dope decreased in viscosity and did not exhibit metal-like luster when stirred.

The afore-said dope, was spun into filaments immediately after its preparation in a manner similar to that in Example 1, and treated by using an apparatus similar to that shown in FIG. 1 wherein SUS 316 stainless steel wire net of 20 mesh was employed as conveyor 7. The speed of the filaments falling onto conveyor 6 was 80 m/min and the speed of conveyor 7 was 0.1 mm/min. The thickness, areal density and width of the filament fleece were 10 mm, 0.039 g/cm$^2$ and 62 mm, respectively. Washing water was atomized on the filaments so that the filaments were not disordered. Drying and heat-treatment were carried out by using an infrared ray lamp and a heated plate at 250° C, respectively.

The heat-treated filaments had 150 denier tenacity of 13.6 g/d, an elongation of 4.0% and an initial modulus of 340 g/d. The filaments, dried but not yet heat-treated, had a tenacity of 15.0 g/d, an elongation of 4.5% and an initial modulus of 380 g/d.

EXAMPLE 6

Using each of the two kinds of filaments manufactured in Example 1, one of which was the dried but not yet heat-treated filaments (B) falling under the invention and the other of which was the filaments falling outside the invention, a cord was manufactured at a first twist (Z twist) number of 46.5/10 cm and a final twist (S twist) number of 46.5/10 cm. Each cord had the following tenacity.

| | Invention | Control |
|---|---|---|
| Tenacity of filaments (g/d) | 21.3 | 17.5 |
| Tenacity of cord (g/d) | 15.9 | 12.0 |
| % Tenacity ratio *1 | 74.5 | 68.5 |

*1-% Tenacity ratio = (Tenacity of cord/tenacity of filament) × 100

Each cord was heat-treated at 220° C under the tension shown below. The heat-treated cord had the following tenacity.

| | Invention | | Control | |
|---|---|---|---|---|
| Tension (g/d) | 0.5 | 1.0 | 0.5 | 1.0 |
| Tenacity of heat-treated cord | 17.0 | 17.2 | 12.1 | 12.7 |
| % Tenacity ratio | 80.0 | 80.8 | 69.1 | 72.5 |

EXAMPLE 7

Polymer A set forth in the Reference Example was dissolved in 9.5% sulfuric acid and deaerated to prepare an anisotropic dope of 20% concentration. The dope was extruded into three kinds of filaments through a spinneret with 1,000 orifices each having a diameter of 0.07 mm, a spinneret with 500 orifices each having a diameter of 0.09 mm and a spinneret with 300 orifices each having a diameter of 0.11 mm, respectively, in manners similar to that in Example 1. These three kinds of filaments had a total fineness of 1,500 denier and finenesses per filament of 1.5, 3 and 5 denier, respectively. These filaments were treated by using an apparatus as shown in FIG. 2 in a manner similar to that in Example 1 wherein the filaments were made to fall onto conveyor 6 at a rate of 120 m/min, conveyor 7 was driven at a rate of 0.3 m/min, the filaments were washed with water for a period of 45 minutes and the heat-treatment was omitted. The thickness, areal density and width of the filaments on conveyor 7 were 14 mm, 0.06 g/cm$^2$ and 120 mm, respectively. The residual sulfuric acid in the three kinds of dried filaments was below 100 ppm based on the weight of the dried filaments.

EXAMPLE 8

Using each of the two kinds of filaments manufactured in Example 1, one of which was dried but not yet heat-treated filaments (B) falling under the invention and the other of which was the filaments falling outside the invention, a cord was manufactured wherein the first twist number and the final twist number were both 38/10 cm. Each cord was treated in a known manner first with an epoxy resin composition and then with a resorcin-formaldehyde latex. Then, the treated cord was embedded in rubber to prepare a cylindrical test specimen with a diameter 25 mm and a length of 50 mm, having 125 cords, embedded therein in parallel to the cylinder axis. The test specimen was vulcanized at 145° C for 30 minutes.

The epoxy resin composition used was an aqueous dispersion of the following composition.

| | |
|---|---|
| Epicoat 812 (epoxy resin, supplied by Shell Chemical Co.) | 3 parts |
| Ethanol | 5 parts |
| Polyvinylpyridine latex | 25 parts |
| Water | 67 parts |

The resorcin-formaldehyde latex used had the following composition and allowed to stand overnight after the preparation.

| | |
|---|---|
| Resorcin | 11 parts |
| Water | 238.4 parts |
| 37% formalin | 16.2 parts |
| NaOH | 0.3 parts |
| Poly-vinylpyridine-styrene-butadiene latex (solid content, 41%) | 244 parts |

The rubber used was a compounded rubber of the following composition.

| | |
|---|---|
| Natural rubber | 90 parts |
| Styrene-butadiene copolymer rubber | 10 parts |
| Carbon black | 40 parts |
| Stearic acid | 2 parts |
| Softener | 10 parts |
| Pine tar | 4 parts |
| Zinc white | 5 parts |
| N-phenyl-β-naphthylamine | 1.5 parts |
| 2-benzothiazolyl disulfide | 0.75 parts |
| Diphenylguanidine | 0.75 parts |
| Sulfur | 2.5 parts |

Each specimen was tested for its compressional stress by compressing it at a rate of 5 mm/min in the direction of the cylinder axis. Results were as follows.

| | Invention | Control |
|---|---|---|
| Stress at 1% compression (kg) | 12.4 | 9.1 |
| Stress at 2% compression (kg) | 22.1 | 17.3 |

These results show that, although the filaments of the invention possess tensile modulus lower than that of the control filaments, the former exhibits a compressional modulus higher than the latter.

EXAMPLE 9

The cords treated with an epoxy resin and a resorcin-aldehyde latex in Example 8 were embedded in a compounded rubber similar to that used in Example 8 to prepare tubular test specimens with an outer diameter of 25 mm and a length of 320 mm having cords embedded therein in parallel to the tube axis. Each specimen was tested for its compression-extension fatigue property using a Goodyear tube fatigue testing machine wherein the tubular specimen was gripped at an angle of 105° C and rotated at the gripped end at 850 revolutions per min. at an internal pressure of 3.5 kg/cm$^2$G.

The cords from the control filaments fractured after 249 minutes had elapsed, which is the average of said three specimens. However, the cords from the filaments (B) fractured after 362 minutes had elapsed, which is the average of said three specimens.

What we claim is:

1. A process for manufacturing fibers by wet spinning an anisotropic dope of an aromatic polymer having aromatic mononucleus or polynucleus divalent radicals, in which chain extending bonds from each aromatic nucleus are coaxial or parallel and oppositely directed, which radicals are selected from the group consisting of (A)

p-phenylene

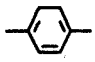

4,4'-biphenylene

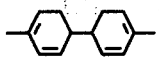

1,4-naphthylene

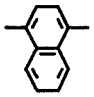

2,5-pyridylene

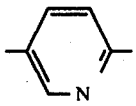

(B)

1,5-naphthylene

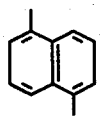

2,6-naphthylene

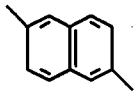

(C)

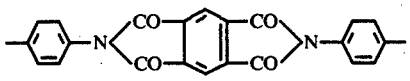

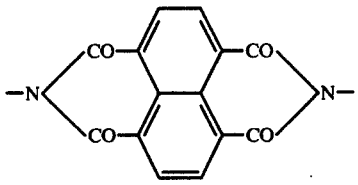

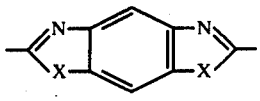

wherein X is a member selected from the group consisting of —O—, —S— and —NH—,
and (D)

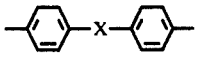

wherein X is composed of two or four enchained atoms such that the divalent radical of the formula exhibits a conjugated system as a whole and which are connected by at least one link composed of a member selected from the group consisting of —NHCO—, —NHCOCOHN— and —CONHNHCO—, the process comprising the steps of dissolving the polymer in at least one solvent selected from the group consisting of sulfuric acid, chlorosulfuric acid, fluorosulfuric acid, dimethylacetamide, N-methylpyrrolidone, tetramethylurea, hexamethylphosphoramide, dimethylsulfoxide and tetramethylene sulfonic acid to form an anisotropic dope, the polymer having an inherent viscosity of at least 3.0 as measured at a concentration of 0.3g per 100 ml of 98% sulfuric acid at 30+ C.

b. forming filaments by extruding the dope into a coagulation bath, c. removing the filaments from the bath, d. depositing the filaments onto a conveyor at a rate greater than the linear speed of the conveyor, e. washing the filaments on the conveyor, and f. drying the resulting filaments.

the steps of the process being conducted in a manner such that the filaments are formed in the substantial absence of any tension being applied to the filaments.

2. A process according to claim 1 wherein said filaments laid on the conveyor are further heat-treated without applying any substantial tension thereto.

3. A process according to claim 1 wherein said filaments taken out from the coagulation bath are once made to fall onto an endless conveyor or a roller at a rate of higher than the linear or circumferential speed of said endless conveyor or roller and then, transferred, while turned over, onto a conveyor moving at a speed substantially equal to the linear or circumferential speed of said endless conveyor or roller.

4. A process according to claim 1 wherein said filaments laid on the conveyor are washed with water and, then, dried in a manner such that the filaments are sandwiched between an endless, foraminous cover belt placed on said filaments and the conveyor.

5. A process according to claim 1 wherein the ratio of the speed of the filaments falling onto the conveyor to the speed of the conveyor is within the range from approximately 100 to approximately 2,000.

6. A process according to claim 1 wherein said filaments on the conveyor are in the form of fleece having an areal density of 0.005 to 0.2 g/cm² based on the dry weight.

7. A process according to claim 1 wherein said filaments on the conveyor are in the form of fleece having an areal density of 0.02 to 0.15 g/cm² based on the dry weight.

8. The process according to claim 1, wherein the aromatic polymer is a polymer selected from the group consisting of poly-p-phenylene terephthalamide, poly-p-benzamide, polyterephthaloylhydrazide, poly-p-phenylene succinylamide, copoly-p-phenylene terephthalamide/terephthaloylhydrazide, copoly-4,4'-biphenylene/p-phenylene terephthalamide,

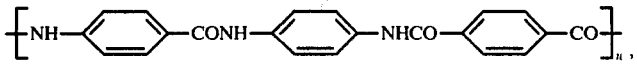

-continued
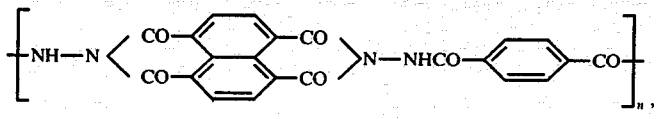
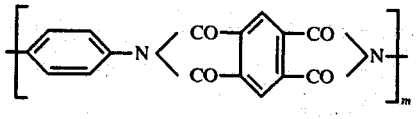
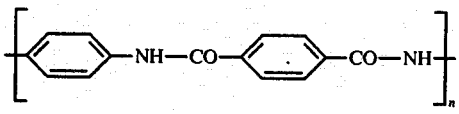
and
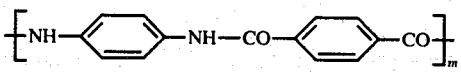
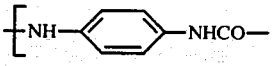
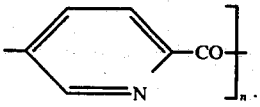
9. The process according to claim 1 wherein the aromatic divalent radicals are substituted with at least one substituent selected from the group consisting of halogen, lower alkyl, nitro, alkoxy and cyano.
* * * * *

UNITED STATES PATENT OFFICE

CERTIFICATE OF CORRECTION

Patent No. 4,016,236 Dated April 5, 1977

Inventor(s) KEISAKU NAGASAWA ET AL

It is certified that error appears in the above-identified patent and that said Letters Patent are hereby corrected as shown below:

Cover page, left column, under the item "[30] Foreign Application Priority Data" change "July 5, 1974" to --June 5, 1974--.

Signed and Sealed this

*nineteenth* Day of *July 1977*

[SEAL]

*Attest:*

RUTH C. MASON
*Attesting Officer*

C. MARSHALL DANN
*Commissioner of Patents and Trademarks*